US010542351B2

(12) United States Patent
Good et al.

(10) Patent No.: US 10,542,351 B2
(45) Date of Patent: Jan. 21, 2020

(54) COUPLING APPARATUSES FOR TRANSCUTANEOUS BONE CONDUCTION DEVICES

(71) Applicant: Cochlear Limited, Macquarie University, NSW (AU)

(72) Inventors: Tobias Good, Västra Frölunda (SE); Henrik Fyrlund, Göteborg (SE)

(73) Assignee: Cochlear Limited, Macquarie University (AU)

( * ) Notice: Subject to any disclaimer, the term of this patent is extended or adjusted under 35 U.S.C. 154(b) by 115 days.

(21) Appl. No.: 15/272,660

(22) Filed: Sep. 22, 2016

(65) Prior Publication Data

US 2018/0084349 A1 Mar. 22, 2018

(51) Int. Cl.
*H04R 25/02* (2006.01)
*H04R 25/00* (2006.01)

(52) U.S. Cl.
CPC ..... *H04R 25/02* (2013.01); *H04R 25/606* (2013.01); *H04R 2225/0213* (2019.05)

(58) Field of Classification Search
CPC ..... H04R 2460/13; H04R 1/05; H04R 2225/021; H04R 2225/63; H04R 1/1016; H04R 1/105
USPC ..... 381/151, 326, 330, 380–381
See application file for complete search history.

(56) References Cited

U.S. PATENT DOCUMENTS 2,151,706 A * 3/1939 Lieber ..... H04R 25/606 181/137
3,030,456 A * 4/1962 Knauert ..... H04R 11/00 381/326
6,320,960 B1 11/2001 Lathrop, II et al.
9,031,274 B2 5/2015 Kasic, II
2002/0012441 A1* 1/2002 Matsunaga ..... A42B 1/245 381/381
2012/0294466 A1 11/2012 Kristo et al.
2012/0302823 A1* 11/2012 Andersson ..... H04R 25/606 600/25
2013/0216078 A1 8/2013 Bewley
2014/0064533 A1 3/2014 Kasic, II
2014/0233765 A1* 8/2014 Andersson ..... H04R 25/606 381/151
2015/0063616 A1 3/2015 Westerkull
2016/0234613 A1 8/2016 Westerkull

FOREIGN PATENT DOCUMENTS

WO 2014/033632 A2 3/2014

OTHER PUBLICATIONS

International Search Report and Written Opinion in corresponding International Application No. PCT/IB2017/055490, dated Jan. 9, 2018, 14 pages.

* cited by examiner

*Primary Examiner* — Suhan Ni
(74) *Attorney, Agent, or Firm* — Edell, Shapiro & Finnan, LLC

(57) ABSTRACT

Presented herein are non-surgical or superficial coupling apparatuses for transcutaneous bone conduction devices. A coupling apparatus comprises a drive plate configured to be detachably connected to a transcutaneous bone conduction device. The drive plate is also connected to an earhook (ear hook) configured to fit over/around a recipient's pinna (auricle) to at least partially support the drive plate. An adhesive member may also be provided to secure the drive plate to the recipient's skin.

23 Claims, 10 Drawing Sheets

COUPLING APPARATUSES FOR TRANSCUTANEOUS BONE CONDUCTION DEVICES

BACKGROUND

Field of the Invention

The present invention relates generally to transcutaneous bone conduction devices.

Related Art

Hearing loss, which may be due to many different causes, is generally of two types: conductive and sensorineural. Sensorineural hearing loss is due to the absence or destruction of the hair cells in the cochlea that transduce sound signals into nerve impulses. Various hearing prostheses are commercially available to provide individuals suffering from sensorineural hearing loss with the ability to perceive sound. For example, cochlear implants use an electrode array implanted in the cochlea of a recipient to bypass the mechanisms of the ear. More specifically, an electrical stimulus is provided via the electrode array to the auditory nerve, thereby causing a hearing percept.

Conductive hearing loss occurs when the normal mechanical pathways that provide sound to hair cells in the cochlea are impeded, for example, by damage to the ossicular chain or ear canal. Individuals suffering from conductive hearing loss may retain some form of residual hearing because the hair cells in the cochlea may remain undamaged.

Individuals suffering from conductive hearing loss typically receive an acoustic hearing aid. Hearing aids rely on principles of air conduction to transmit acoustic signals to the cochlea.

In particular, a hearing aid typically uses an arrangement positioned in the recipient's ear canal or on the outer ear to amplify a sound received by the outer ear of the recipient. This amplified sound reaches the cochlea causing motion of the perilymph and stimulation of the auditory nerve.

In contrast to hearing aids, which rely primarily on the principles of air conduction, certain types of hearing prostheses, commonly referred to as bone conduction devices, convert a received sound into vibrations. The vibrations are transferred through the skull to the cochlea causing generation of nerve impulses, which result in the perception of the received sound. Bone conduction devices are suitable to treat a variety of types of hearing loss and may be suitable for individuals who cannot derive sufficient benefit from acoustic hearing aids, cochlear implants, etc., or for individuals who suffer from stuttering problem

SUMMARY

In one aspect, a coupling apparatus for a transcutaneous bone conduction device is provided. The coupling apparatus comprises: a drive plate configured to be detachably connected to the transcutaneous bone conduction device; and an earhook extending from the drive plate, wherein the earhook is configured to fit over a recipient's pinna to at least partially support the drive plate and the transcutaneous bone conduction device when connected to the drive plate.

BRIEF DESCRIPTION OF THE DRAWINGS

Embodiments of the present invention are described herein in conjunction with the accompanying drawings, in which.

DETAILED DESCRIPTION

Transcutaneous bone conduction systems typically comprise external components as well as implanted components (i.e., elements located beneath a recipient's skin/tissue). The implanted components typically comprise an implanted anchor system fixed to a recipient's skull bone to which the external components are coupled via a transcutaneous magnetic field. That is, the external components typically include one or more permanent magnets, and the implanted anchor system includes one or more implanted magnetic components that can be magnetically coupled to the permanent magnets in the external component. The implantable components are implanted during a surgical procedure and, as a result, require a significant commitment by the recipient to continued future use of the bone conduction system. Additionally, surgical implantation may not be possible or desirable for all recipients. As such, there is a need for non-surgical bone conduction device systems that can be used, for example, on a temporary basis to enable recipients to trial the use of a bone conduction device for a period of time or that can used on a long-term basis (e.g., pediatric use).

Embodiments presented herein are generally directed to non-surgical or superficial coupling apparatuses for transcutaneous bone conduction devices. A coupling apparatus in accordance with the embodiments presented herein comprises a drive plate configured to be detachably connected to a transcutaneous bone conduction device. The drive plate is also connected to an earhook (ear hook) configured to fit over/around a recipient's pinna (auricle) to at least partially support the drive plate. An adhesive member may also be provided to secure the drive plate to the recipient's skin. The coupling apparatuses presented herein may be more discrete, comfortable and/or aesthetically appealing that current non-surgical bone conduction device solutions.

Figure 1A:
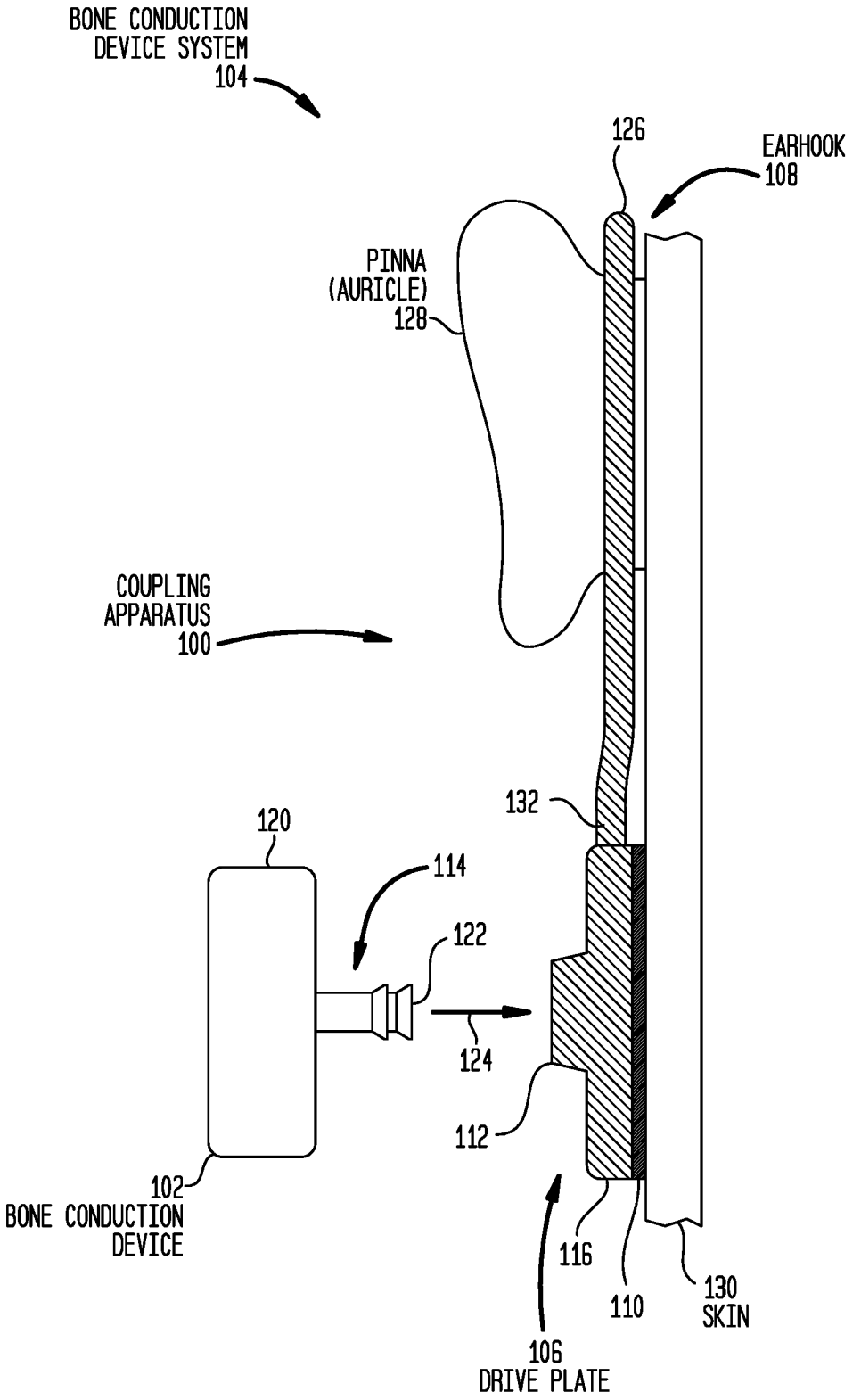
FIG. 1A is a rear view of an exemplary coupling apparatus in accordance with embodiments presented herein.
Figure 1B:
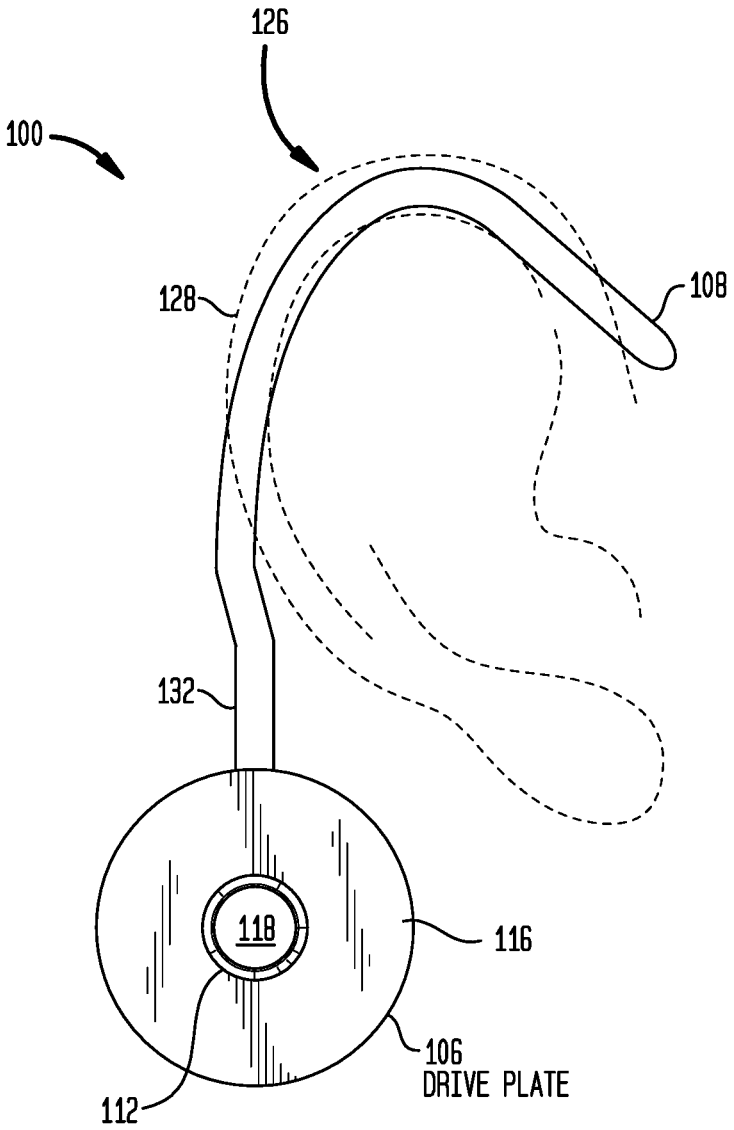
FIG. 1B is a side view of the exemplary coupling apparatus of FIG. 1A.

FIG. 1A is a rear view of a non-surgical or superficial coupling apparatus 100 in accordance with embodiments presented herein that is configured to attach, fasten or otherwise couple a transcutaneous bone conduction device 102 to a recipient. FIG. 1B is a side view of the coupling apparatus 100 when worn by the recipient of the bone conduction device 102. In FIG. 1A, the coupling apparatus 100 is shown with the bone conduction device 102, while the bone conduction device has been omitted from FIG. 1B for ease of illustration. Collectively, the coupling apparatus 100 and the bone conduction device 102 form a non-surgical or superficial bone conduction device system 104. For ease of description, FIGS. 1A and 1B will be described together.

As shown in FIGS. 1A and 1B, the coupling apparatus 100 comprises a drive plate 106, an earhook (ear hook) 108, and an adhesive member 110. The drive plate 106 is configured to be detachably connected to the bone conduction device 102 and is configured to transfer vibration generated by the bone conduction device to the recipient. More specifically, the bone conduction device 102 comprises one or more sound input elements (not shown), such as one or more microphones, a telecoil, an audio port, etc., that are configured to receive sound signals. The bone conduction device 102 also comprises a sound processor and an actuator, all of which have been omitted from FIG. 1A for ease of illustration. In operation, the sound input elements convert received sound signals into electrical signals that are processed by the sound processor. The sound processor then generates, based on the signals received from the sound input elements, control signals which cause the actuator to generate mechanical motion of one or more components and, accordingly, impart vibration to the recipient via the drive plate 106.

A drive plate of a coupling apparatus in accordance with embodiments presented can be detachably connected to a bone conduction device using a number of different arrangements. In the specific embodiment of FIGS. 1A and 1B, the drive plate 106 includes a snap-in coupler 112 configured to "snap couple" the bone conduction device 102 to the drive plate. The snap-in coupler 112 is a protrusion that, in the illustrative embodiment, extends from a base 116 of the drive plate 106. In one form, the snap-in coupler 112 has a general frustoconical shape.

As shown in FIG. 1B, the snap-in coupler 112 includes an aperture 118. The aperture 118 has an arrangement (e.g., size, shape, internal features, etc.) so as to receive and mate with a corresponding snap-in coupler 114 of the bone conduction device 102. The snap-coupler 114 is a male member that extends from a main portion 120 of the bone conduction device 102. The aperture 118 of the snap-in coupler 112 and a distal end 122 of the snap-coupler 114 have corresponding structural features/arrangements such that, when the distal end 122 is pushed into the aperture 118, as shown by arrow 124, the bone conduction device 102 is mechanically attached/connected to the drive plate 106. The bone conduction device 102 can be detached from the drive plate 106 by removing (e.g., pulling) the distal end 122 from the aperture 118.

It is to be appreciated that the specific snap-in coupling mechanism of FIGS. 1A and 1B is illustrative and, as noted above, a drive plate in accordance with embodiments presented herein may be coupled to a bone conduction device using different mechanisms. For example, in alternative embodiments a drive plate may include one or more magnetic components (e.g., magnets) configured to be magnetically coupled to one or more magnetic components of a bone conduction device (i.e., a magnetic coupling). In other embodiments, a drive plate may include a threaded member (male or female) that is configured to mate with a corresponding threaded member of a bone conduction device (i.e., a screw-in coupling). Again, these specific types of coupling mechanisms are illustrative.

As noted, in addition to the drive plate 106, the coupling apparatus 100 also comprises an earhook 108 extending from the drive plate. The earhook 108 includes a curved portion 126 that curves at least partially around and behind the outer ear, more specifically the pinna (auricle) 128, of a recipient. For ease of illustration, the recipient's pinna 128 is shown in FIG. 1B using dashed lines.

The curved portion 126 of the earhook 108 has an arcuate or crescent shape to wrap around and securely grasp the pinna 128, although other configurations are possible. For example, the skin-contacting surface of the curved portion 126 may have an arcuate shape while the outer surface thereof is substantially rectilinear. In one embodiment, the curved portion 126 is formed using plastic, thermoplastic, etc. However, it is to be appreciated that the curved portion 126, and more generally the entire earhook 108, can be formed from many different materials with similar or different properties.

For example, in one embodiment, the curved portion 126 is formed from a substantially rigid material and additionally includes an outer covering formed from a soft/compressible material, such as elastomer (e.g., silicone). In these embodiments, the curved portion 126 can conform to the shape of the pinna 128 and/or make wearing the earhook 108 more comfortable for the recipient.

In general, the curved portion 126 is substantially rigid so as to enable the pinna 128 to support the weight of the drive plate 106 as well as the weight of the bone conduction device 102 when the bone conduction device is coupled with the drive plate. More specifically, it is known that the mass of an object is a fundamental property of the object (i.e., a measure of the amount of matter in the object). It is also known that the weight of an object is defined as the force of gravity on the object and may be calculated as the mass of the object times the acceleration of gravity. When the bone conduction device 102 is worn by the recipient (i.e., when the bone conduction device is coupled to the drive plate 106), and the recipient is in an upright position, gravitational pull exerts a weight force on the bone conduction device (i.e., assuming the recipient is standing upright, gravity pulls the bone conduction device in an inferior or downward direction). Because the weight force is applied at a distance from the recipient's skin 130, the weight force causes a moment ($M_1$) to be applied to the bone conduction device 102 and the drive plate 106. A "moment" is a measure of the tendency of a force to cause an object to rotate about a specific point or axis. In accordance with the embodiments presented herein, the earhook 108 has sufficient structural rigidity so as to enable the pinna 128 to counter this rotational momentum created by the mass of the bone conduction device 102.

In certain embodiments, the curved portion 126 of the earhook 108 is partially flexible within the plane of the earhook 108 (i.e., within a plane generally parallel to the recipient's skin 130) and is resiliently biased in the direction of the pinna 128 to provide a compressive pressure on a superior portion of the pinna 128. In other words, the curved portion 126 can be configured to be stretched open in opposition to an inward biasing pressure, but is configured to naturally return to its closed state when the opening force is removed so as to securely gasp the pinna 128.

In the embodiment of FIGS. 1A and 1B, the earhook 108 also comprises a portion 132 connecting the curved portion 126 to the drive plate 106. In certain embodiments, the portion 132 is integrated/unitary with the drive plate 106, while in other embodiments the portion 132 can be detachable from the drive plate 106. That is, the portion 132 and the drive plate 106 can be permanently connected to one another or detachably connected to one another.

Also shown in FIG. 1A is an adhesive member 110. In the arrangement of FIGS. 1A and 1B, the adhesive member 110 is disposed on a skin-facing surface of the base 116 of the drive plate 106. The adhesive member 110 is configured to adhere/fix the base 116 of the drive plate 106 to the recipient's skin 130 (i.e., ensure a connection between the drive plate and skull such that the drive plate 106 can be retained in an optimal position). In other words, since the earhook 108 is configured to support the drive plate 106 and the bone conduction device 102, the adhesive member 110 is generally configured to prevent movement of the drive plate 106 relative to the recipient's skin 130 resulting, for example, from the recipient's daily activities. As such, the adhesive member 110 can include an adhesive that has a relatively mild strength.

As noted above, an earhook in accordance with embodiments presented herein, such as earhook 108, is configured to support the weight of a drive plate and the weight of a bone conduction device when the bone conduction device is coupled to the drive plate. It is to be appreciated that such earhooks in accordance with embodiments presented herein may have different arrangements than that shown in FIGS. 1A and 1B. For example, FIGS. 2A, 2B, 2C, and 2D are diagrams illustrating alternative coupling apparatuses 200(A), 200(B), 200(C), and 200(D), respectively, that each include different earhooks 208(A), 208(B), 208(C), and 208(D), respectively. For ease of illustration, the earhooks 208(A), 208(B), 208(C), and 208(D) are each shown separate from a recipient's pinna.

Figure 2A:
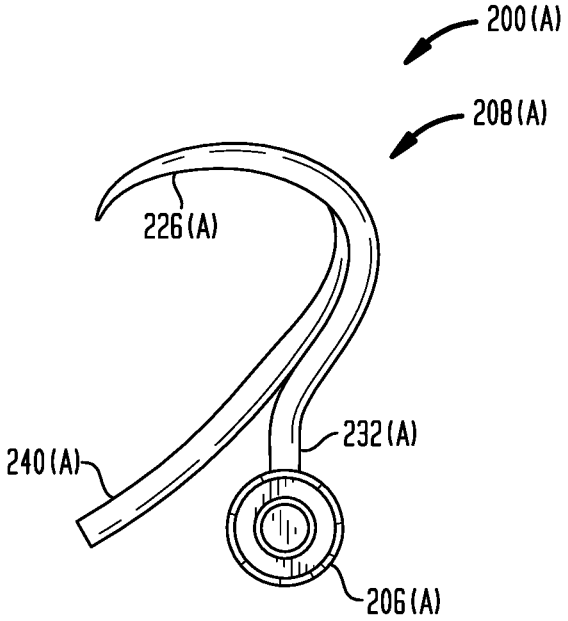
FIGS. 2A, 2B, 2C, and 2D are side views of exemplary coupling apparatuses in accordance with embodiments presented herein.

Referring first to FIG. 2A, the earhook 208(A) is attached to a drive plate 206(A). The earhook 208(A) includes a curved portion 226(A) that curves at least partially around and behind a recipient's pinna. The curved portion 226(A) has a general arcuate or crescent shape to wrap around and securely grasp the pinna, although other configurations, including those described above with reference to FIGS. 1A and 1B, can be used in alternative arrangements.

The curved portion 226(A) is substantially rigid so as to enable the recipient's pinna to support the weight of the drive plate 206(A) as well as the weight of a bone conduction device when the bone conduction device is coupled with the drive plate (i.e., sufficient structural rigidity so as to enable the pinna to counter rotational momentum created by the weight of the bone conduction device). The earhook 208(A) also comprises a portion 232(A) located between the curved portion 226(A) and the drive plate 206(A).

As shown in FIG. 2A is a supplemental support member 240(A) that is also configured to assist in countering rotational momentum created by the weight of the bone conduction device. The supplemental support member 240(A) is integrated with the curved portion 226(A) and forms part of the earhook 208(A). In the arrangement of FIG. 2A, the curved portion 226(A) is configured to extend over a superior portion of the recipient's pinna, while the supplemental support member 240(A) is configured to extend under an inferior portion of the recipient's pinna. The curved portion 226(A) and the supplemental support member 240(A) may each be resiliently biased so as to place opposing compressive forces on the pinna. That is, the curved portion 226(A) and the supplemental support member 240(A) may be configured to collectively clamp/grip the recipient's pinna. The use of the supplemental support member 240(A) may provide added rotational stability for the coupling apparatus 200(A) relative to arrangements that include an earhook with only a curved portion extended over the superior portion of a recipient's pinna.

Figure 2B:
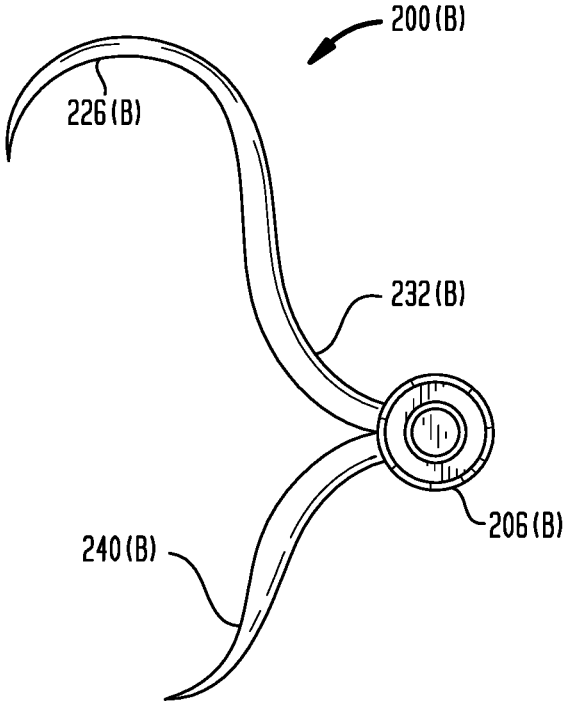

Referring next to FIG. 2B, the earhook 208(B) is attached to a drive plate 206(B). The earhook 208(B) includes a curved portion 226(B) that curves at least partially around and behind a recipient's pinna. The curved portion 226(B) has a general arcuate or crescent shape to wrap around and securely grasp the pinna, although other configurations, including those described above with reference to FIGS. 1A and 1B, can be used in alternative arrangements.

The curved portion 226(B) is substantially rigid so as to enable the recipient's pinna to support the weight of the drive plate 206(B) as well as the weight of a bone conduction device when the bone conduction device is coupled with the drive plate (i.e., sufficient structural rigidity so as to enable the pinna to counter rotational momentum created by the weight of the bone conduction device). The earhook 208(B) also comprises a portion 232(B) located between the curved portion 226(B) and the drive plate 206(B).

As shown in FIG. 2B is a supplemental support member 240(B) that is also configured to assist in countering the rotational momentum created by the weight of the bone conduction device. The supplemental support member 240(B) is separate from the earhook 208(B) and extends directly from the drive plate 206(B), rather than from the curved portion 226(B) as in the arrangement of FIG. 2A. However, similar to the arrangement of FIG. 2A, the curved portion 226(B) is configured to extend over a superior portion of the recipient's pinna, while the supplemental support member 240(B) is configured to extend under an inferior portion of the recipient's pinna. The curved portion 226(B) and the supplemental support member 240(B) may each be resiliently biased so as to place opposing compressive forces on the pinna. That is, the curved portion 226(B) and the supplemental support member 240(B) may be configured to collectively clamp/grip the recipient's pinna. Again, the use of the supplemental support member 240(B) may provide added rotational stability for the coupling apparatus 200(B) relative to arrangements that include an earhook with only a curved portion extended over the superior portion of a recipient's pinna.

Figure 2C:
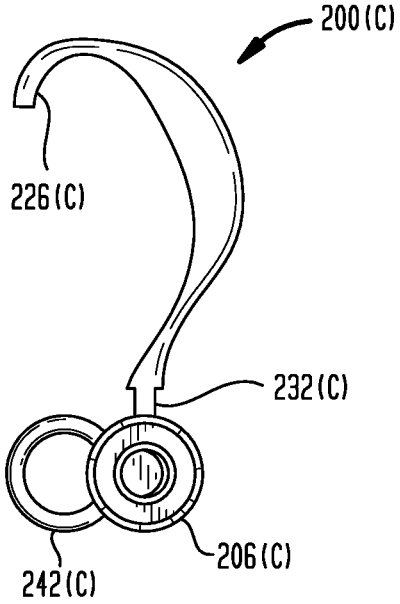

Referring next to FIG. 2C, the earhook 208(C) is attached to a drive plate 206(C). The earhook 208(C) includes a curved portion 226(C) that curves at least partially around and behind a recipient's pinna. The curved portion 226(C) has a general arcuate or crescent shape to wrap around and securely grasp the pinna, although other configurations, including those described above with reference to FIGS. 1A and 1B, can be used in alternative arrangements.

The curved portion 226(C) is substantially rigid so as to enable the recipient's pinna to support the weight of the drive plate 206(C) as well as the weight of a bone conduction device when the bone conduction device is coupled with the drive plate (i.e., sufficient structural rigidity so as to enable the pinna to counter rotational momentum created by the weight of the bone conduction device). The earhook 208(C) also comprises a portion 232(C) located between the curved portion 226(C) and the drive plate 206(C).

As shown in FIG. 2C is a spacer 242(C) that is configured to space the drive plate 206(C) from the recipient's pinna. More specifically, the spacer 242(C) is a curved (e.g., crescent or U-shaped) member that extends from the drive plate 206(C) so as maintain the drive plate some distance from the pinna and, accordingly, reduce interference of the pinna with operation of the bone conduction device (e.g., reduce feedback caused by vibration of the pinna). In one embodiment, the spacer 242(C) is formed from a vibration isolation material, such as silicone rubber.

Figure 2D:
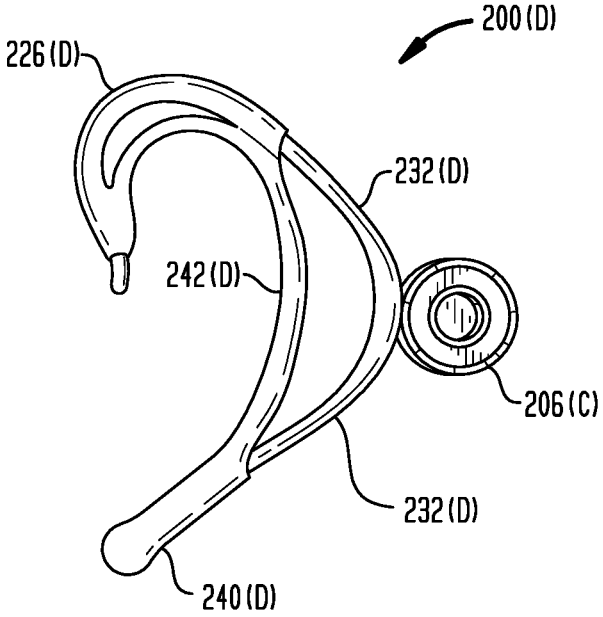

Referring next to FIG. 2D, the earhook 208(D) is attached to a drive plate 206(D). The earhook 208(D) includes a curved portion 226(D) that curves at least partially around and behind a recipient's pinna. The curved portion 226(D) has a general arcuate or crescent shape to wrap around and securely grasp the pinna, although other configurations, including those described above with reference to FIGS. 1A and 1B, can be used in alternative arrangements.

The curved portion 226(D) is substantially rigid so as to enable the recipient's pinna to support the weight of the drive plate 206(D) as well as the weight of a bone conduction device when the bone conduction device is coupled with the drive plate (i.e., sufficient structural rigidity so as to enable the pinna to counter rotational momentum created by the weight of the bone conduction device). The earhook 208(D) also comprises a portion 232(D) located between the curved portion 226(D) and the drive plate 206(D).

Shown in FIG. 2D is a supplemental support member 240(D) that is also configured to assist in countering the rotational momentum created by the weight of the bone conduction device. In the arrangement of FIG. 2D, the portion 232(D) is a curved member that connects the supplemental support member 240(D) to the curved portion 226(B) such that supplemental support member 240(D) forms part of the earhook 208(A). Similar to the arrangements of FIGS. 2A and 2B, the curved portion 226(D) is configured to extend over a superior portion of the recipient's pinna, while the supplemental support member 240(D) is configured to extend under an inferior portion of the recipient's pinna. The curved portion 226(D) and the supplemental support member 240(D) may each be resiliently biased so as to place opposing compressive forces on the pinna. That is, the curved portion 226(D) and the supplemental support member 240(D) may be configured to collectively clamp/grip the recipient's pinna. The use of the supplemental support member 240(D) may provide added rotational stability for the coupling apparatus 200(D) relative to arrangements that include an earhook with only a curved portion extended over the superior portion of a recipient's pinna.

FIG. 2D also illustrates a spacer 242(D) that is configured to space the drive plate 206(D) from the recipient's pinna. More specifically, the spacer 242(D) is a curved member that extends from the curved portion 226(D) to the supplemental support member 240(D) behind the recipient's pinna, between the pinna and the portion 232(B). As such, the spacer 242(D) maintains the drive plate some distance from the pinna and, accordingly, reduces interference of the pinna with operation of the bone conduction device (e.g., reduce feedback caused by vibration of the pinna). In one embodiment, the spacer 242(D) is formed from a vibration isolation material, such as silicone rubber.

Figure 3:
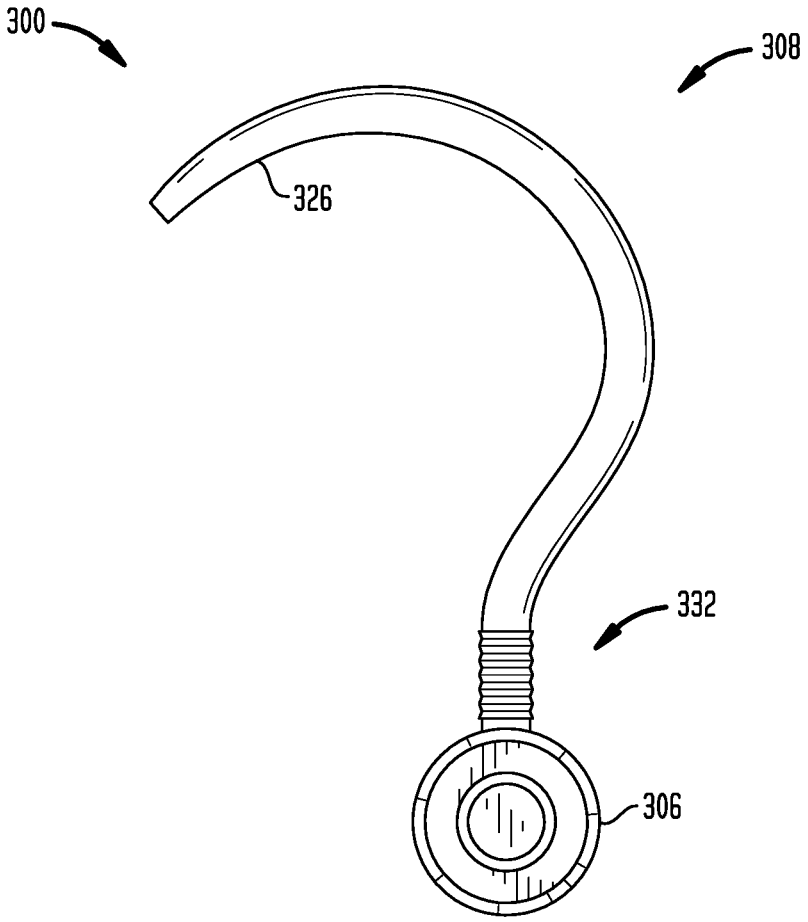
FIG. 3 is a side view of another exemplary coupling apparatus in accordance with embodiments presented herein.

FIG. 3 is a diagram illustrating another coupling apparatus 300 in accordance with embodiments presented herein. The coupling apparatus 300 comprises an earhook 308 that is attached to a drive plate 306 via a flexible portion 332. Similar to the above embodiments, the earhook 308 includes a curved portion 326 that curves at least partially around and behind a recipient's pinna (not shown in FIG. 3) so as to securely grasp the pinna. Again other configurations, including those described above with reference to FIGS. 1A and 1B, can be used in alternative arrangements.

The curved portion 326 is substantially rigid so as to enable the recipient's pinna to support the weight of the drive plate 306 as well as the weight of a bone conduction device when the bone conduction device is coupled with the drive plate (i.e., sufficient structural rigidity so as to enable the pinna to counter rotational momentum created by the weight of the bone conduction device). As noted above, the earhook 308 also comprises a flexible portion 332 located between the curved portion 326 and the drive plate 306 (i.e., connecting the curved portion to the drive plate). The flexible portion 332 is resiliently flexible so as to enable rotational movement of the drive plate 306 relative to the curved portion 326 and/or the remainder of the earhook 308. The configuration of the flexible portion 332 to enable rotational movement of the drive plate 306 relative to the curved portion 326 enables adjustments in the angle of attachment of the drive plate to fit/accommodate anatomical differences between different recipients, thereby ensuring that a base of the drive plate 306 can lie substantially parallel to the surface of the skin of different recipients. In certain examples, the flexible portion 332 could also function as a vibration decoupler that prevents the ear-hook from vibrating and radiate sounding, thereby reducing the risk for feedback.

Figure 4A:
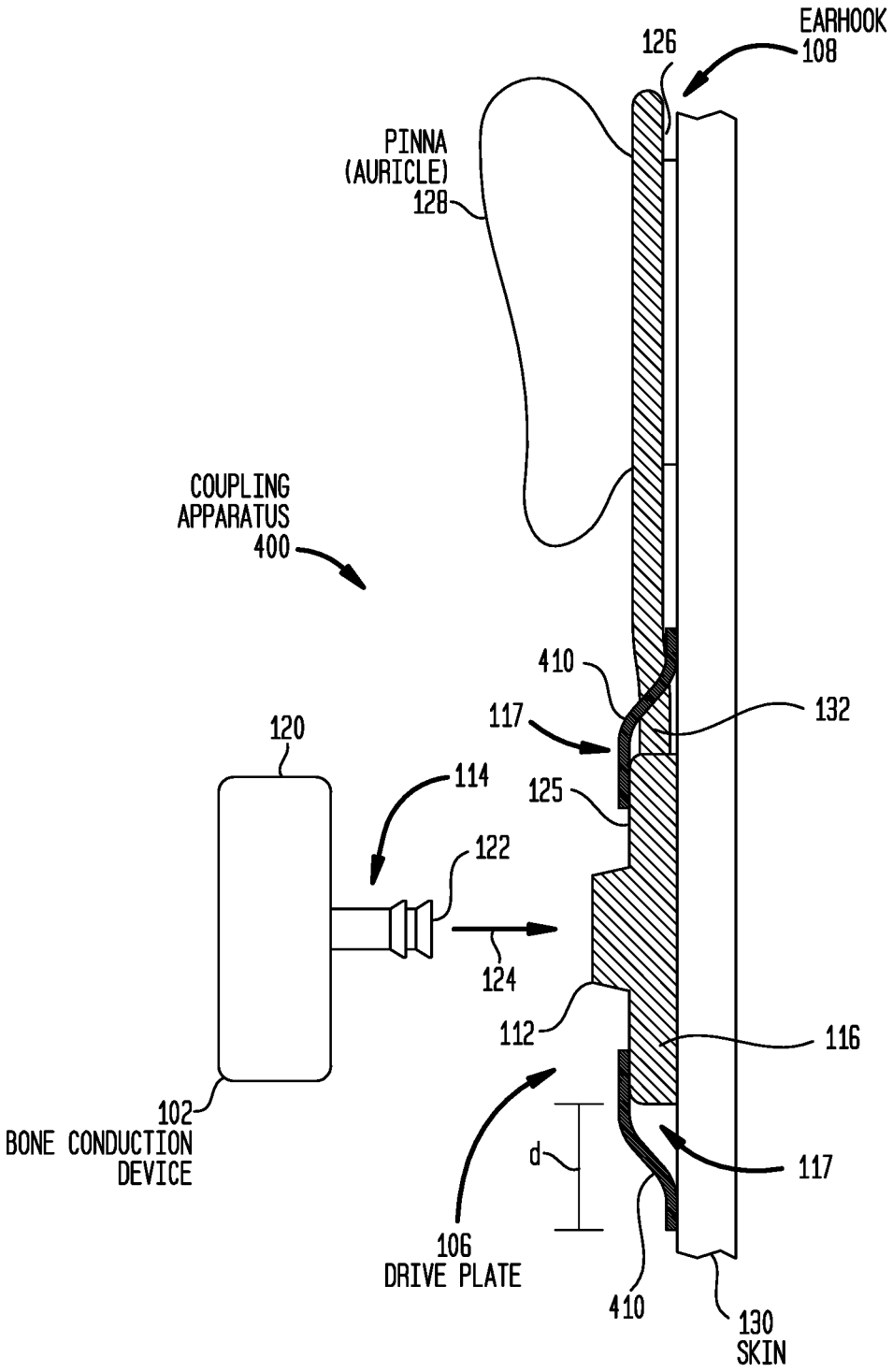
FIG. 4A is a rear view of an exemplary coupling apparatus in accordance with embodiments presented herein.
Figure 4B:
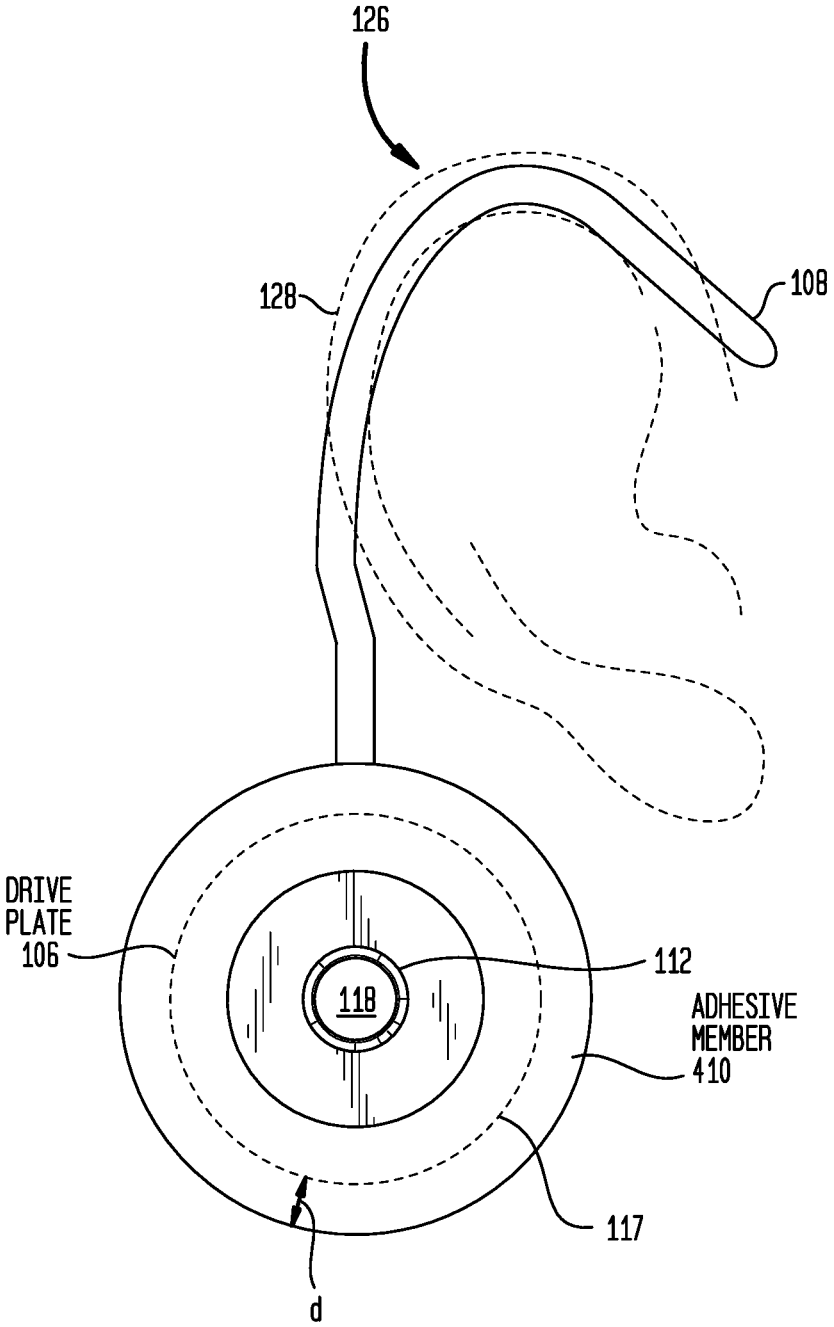
FIG. 4B is a side view of the exemplary coupling apparatus of FIG. 4A.

As noted above, FIGS. 1A and 1B illustrate a coupling apparatus 100 in which an adhesive member 110 is disposed on a skin-facing surface of the base 116 of the drive plate 106. It is to be appreciated that coupling apparatuses in accordance with alternative embodiments can include different adhesive members. For example, FIGS. 4A and 4B are rear and side views, respectively of a non-surgical or superficial coupling apparatus 400 in accordance with embodiments presented herein. The coupling apparatus 400 of FIGS. 4A and 4B is similar to the apparatus of FIGS. 1A and 1B and includes the drive plate 106 and the earhook 108. Also shown in FIG. 4A is the bone conduction device 102.

Although the coupling apparatus 400 includes the drive plate 106 and the earhook 108, the coupling apparatus 400 includes an adhesive member 410 that is different from the one shown in FIGS. 1A and 1B. The adhesive member 410 has an annular shape that is configured to extend over at least a portion of the drive plate 106. More specifically, the adhesive member 410 is disposed over at least the outer edge 117 of the base 116 of the drive plate 106 and extend a distance (d) out from the outer edge. As such, the adhesive member 410 is configured to adhere to the surface 125 of the base 116 that faces away from the recipient's skin 130 and to adhere to the recipient's skin 130 disposed around the outer edge 117 of the base 116. As a result, the adhesive member 410 places a compression force on the drive plate 106 in order to fix the location of the drive plate 106. Since the adhesive member 410 is disposed over (on top of) the drive plate 106, the adhesive member 410 is sometimes referred to herein as an over-adhesive member. For ease of illustration, the adhesive member 410 is shown in cross-section in FIG. 4A.

Although FIGS. 4A and 4B illustrate an annular shaped over-adhesive member 410, it is to be appreciated that over-adhesive members in accordance with embodiments presented herein may have different shapes. For example, over-adhesive members in accordance with embodiments presented herein can have rectangular shapes, crescent/arcuate shapes, etc. In addition, depending on the shape, more than one over-adhesive member may be used in certain embodiments. The use of an over-adhesive member allows the drive plate 106 to be relatively small, while still providing a relatively large adhesive surface. Additionally, the use of an over-adhesive member may prevent the vibration attenuation in the carrier, if it is formed from a compliant material.

Figure 5A:
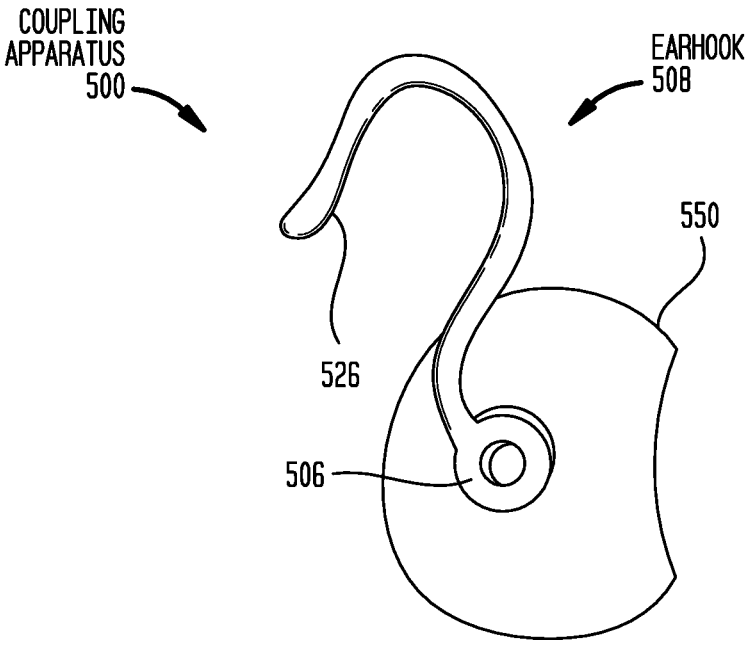
FIGS. 5A, 5B, and 5C are diagrams illustrating another exemplary coupling apparatus in accordance with embodiments presented herein.
Figure 5B:
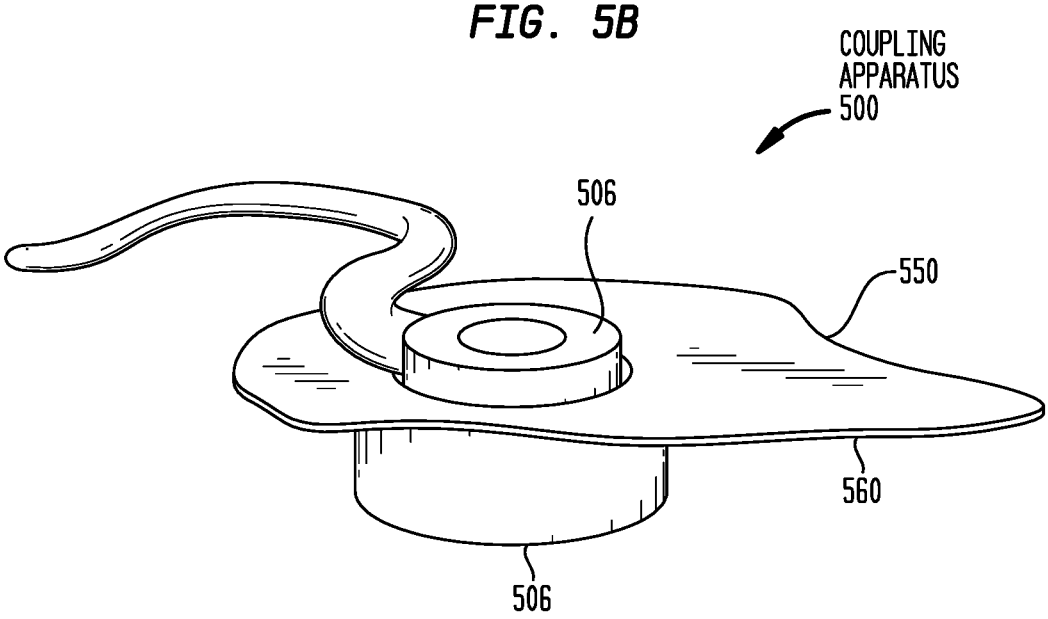
Figure 5C:
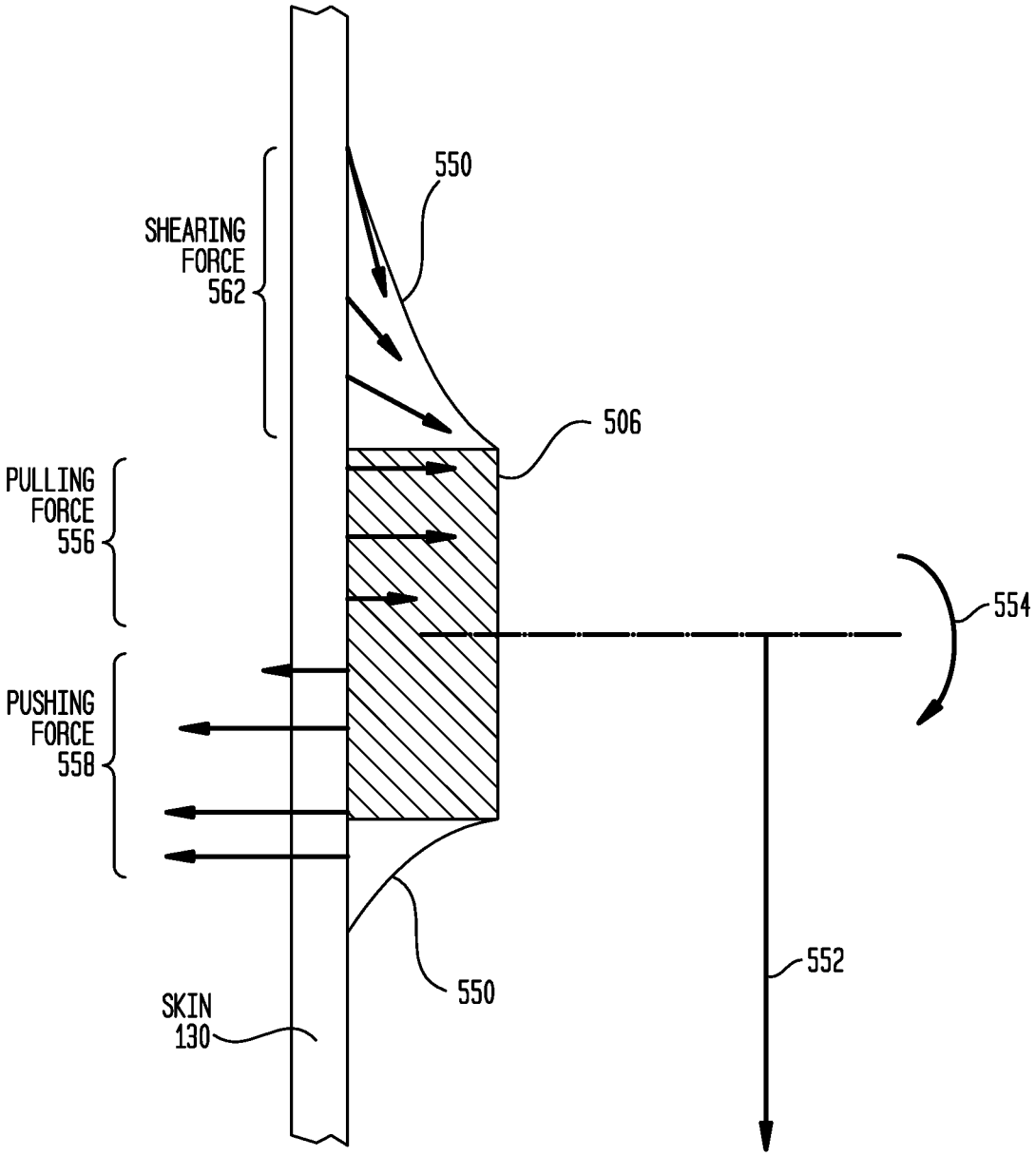

FIGS. 5A and 5B are side and bottom-perspective views, respectively, of another non-surgical or superficial coupling apparatus 500 in accordance with embodiments presented herein. FIG. 5C is a schematic diagram illustrate a side-view (parallel to the recipient's skin) of the coupling apparatus 500 of FIGS. 5A and 5B. For ease of description, FIGS. 5A, 5B, and 5C will be described together.

The coupling apparatus 500 comprises a drive plate 506, an earhook 508, and an elastic adhesive carrier 550. The drive plate 506 is configured to be detachably connected to a bone conduction device (not shown in FIGS. 5A-5C) and is configured to transfer vibration generated by the bone conduction device to the recipient. Similar to the above embodiments, the earhook 508 includes a curved portion 526 that curves at least partially around and behind a recipient's pinna (not shown in FIGS. 5A-5C) so as to securely grasp the pinna. Again other configurations, including those described above with reference to FIGS. 1A and 1B, are possible. For ease of illustration, the earhook 508 has been omitted from FIG. 5C.

The curved portion 526 is substantially rigid so as to enable the recipient's pinna to support the weight of the drive plate 106 as well as the weight of a bone conduction device coupled to the drive plate. More specifically, as explained above with reference to FIGS. 1A and 1B, the weight of an object is defined as the force of gravity on the object and may be calculated as the mass of the object times the acceleration of gravity. As shown in FIG. 5C, when a bone conduction device is coupled to the drive plate 506, and the recipient is in an upright position, gravitational pull exerts a weight force 552 on the bone conduction device (i.e., assuming the recipient is standing upright, gravity pulls bone conduction device in an inferior or downward direction). Because the weight force is applied at a distance from the recipient's skin 130, the weight force causes a moment ($M_1$) 554 to be applied to the bone conduction device.

In general, the earhook 508 has sufficient structural rigidity so as to enable the recipient's pinna to counter this rotational momentum created by the weight of the bone conduction device. However, as shown in FIG. 5C, the moment 554 causes the drive plate 506 (and the attached bone conduction device) to exert pulling forces 556 on a portion of the recipient's skin 130 adjacent to a first section of the drive plate, but also to exert pushing forces 558 on a different portion of the recipient's skin adjacent to a second section of the drive plate. Therefore, if an adhesive member is disposed between the drive plate 506 and the recipient's skin, the adhesive member is subject to pulling forces at a superior section and pushing forces at an inferior section. In the embodiment of FIGS. 5A-5C, the elastic adhesive carrier 550 is arranged so that a sheer force component is applied to the adhesives carried on the elastic adhesive carrier 550, rather than strictly pulling forces, so as to optimize the adhesive bonding.

More specifically, adhesive bonding is more resilient to sheering forces than pulling forces. To capitalize on this adhesive bonding property, an adhesive is disposed on a skin-facing surface 560 of the elastic adhesive carrier 550 and the adhesive carrier is stretched away from the drive plate 506 to place the elastic adhesive carrier 550 under tension. As a result, the adhesive disposed on the skin-facing surface 560 of the elastic adhesive carrier 550 is subject to a compound sheering force 562 at one or more locations, thereby improving the adhesive bonding strength of the adhesive. The sheering force 562 comprises a strictly sheer component (introduced by the tensioned elastic adhesive carrier 550) and a strictly pulling component (attributable to the rotational moment of the bone conduction device).

Although FIGS. 5A-5C illustrate arrangements in which the elastic adhesive carrier 550 is disposed around an outer circumference of the drive plate, it is to be appreciated that other arrangements for elastic adhesive carriers are possible. For example, in alternative embodiments, an elastic adhesive carrier can extend only in superior and inferior directions from the drive plate (e.g., a rectangular or oval elastic adhesive carrier).

Figure 6:
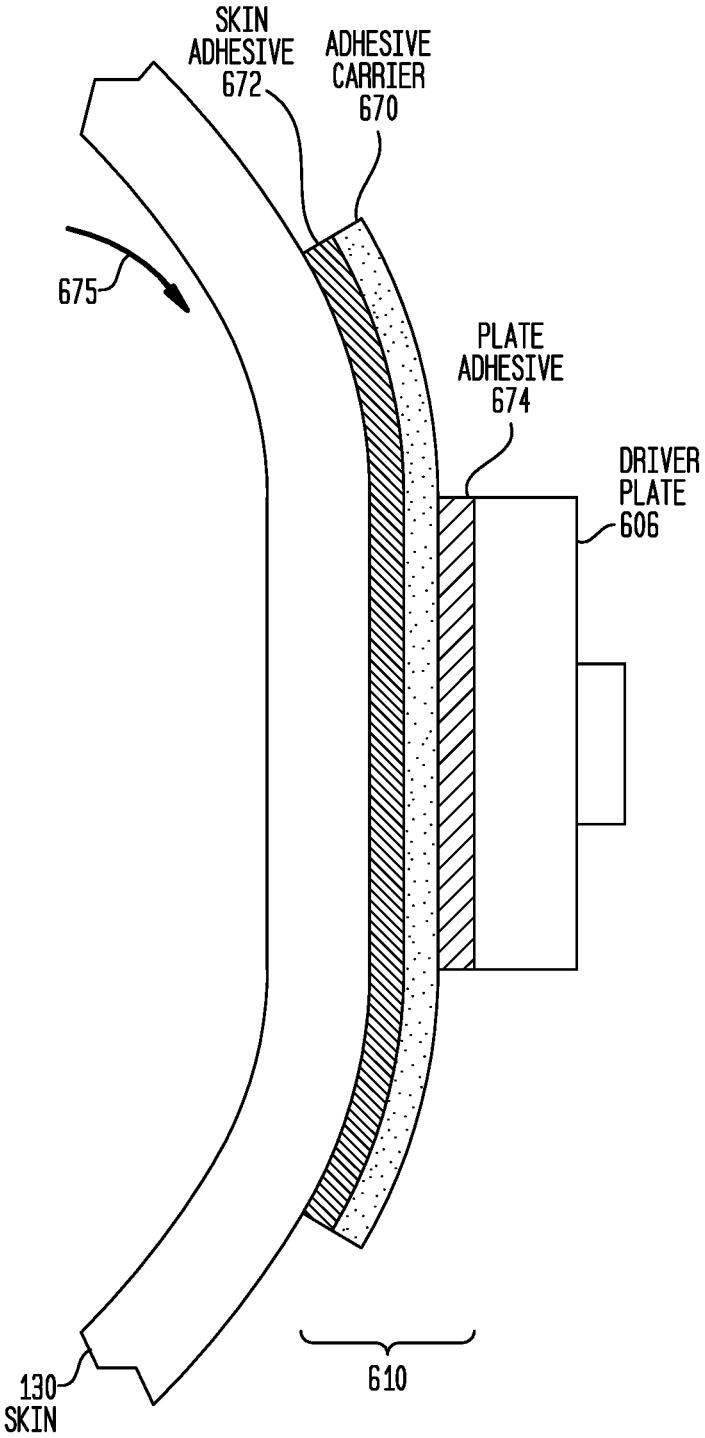
FIG. 6 is a schematic diagram illustrating a layered adhesive member in accordance with embodiments presented herein.

FIG. 6 is a schematic diagram illustrating a layered adhesive member 610 that can be used with a drive plate 606 in accordance with embodiments presented herein. Drive plate 606 may be arranged as described elsewhere herein and is configured to be coupled with a bone conduction device (not shown in FIG. 6).

The layered adhesive member 610 of FIG. 6 is configured to be disposed between the drive plate 606 and the recipient's skin 130. The layered adhesive member 610 is formed by an adhesive carrier 670, a skin adhesive 672, and a plate adhesive 674. The adhesive carrier 670 is a relatively stiff yet flexible member formed, for example, from a plastic material. The skin adhesive 672 is disposed on a skin-facing surface of the adhesive carrier, while the plate adhesive 674 is disposed on the opposing surface (i.e., the non skin-facing surface) of the carrier. As shown, the adhesive carrier 670 has a large skin-facing surface on which the skin adhesive 672 is disposed, while the plate adhesive 672 is disposed on a smaller surface area that is substantially the same size as the drive plate 606. The larger skin-facing surface area of the adhesive carrier 670 enables the skin adhesive 672 to be a relatively milder adhesive than the plate adhesive 672.

In other words, the drive plate 606 has a relative small surface area on which an adhesive can be disposed. To increase the available surface area for adhesion to the recipient's skin 130, the adhesive carrier 670 is interposed between the drive plate 606 and the recipient's skin. As such, a relatively strong plate adhesive 674 can be used to adhere the drive plate 606 to the adhesive carrier 670, while, due to the larger surface area of the adhesive carrier 670, a relatively milder skin adhesive 672 can be used to adhere the adhesive carrier (and the drive plate and the bone conduction device) to the recipient's skin 130. Additionally, the location of the drive plate 606 at a central location of the adhesive carrier 670 results in at least some of the skin adhesive 672 being subject to sheering forces 675, improving the adhesive bonding between the skin adhesive and the skin 130.

It is to be appreciated that the layered adhesive member 610 of FIG. 6 can be used with an earhook as described elsewhere herein. However, for ease of illustration, an earhook has been omitted from FIG. 6.

Figure 7A:
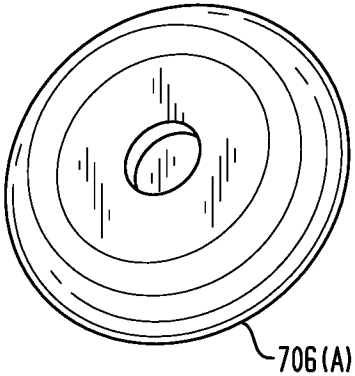
FIGS. 7A, 7B, 7C, and 7D are perspective views of drive plates in accordance embodiments presented herein.
Figure 7B:
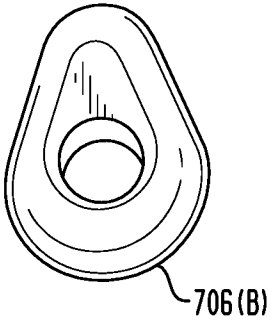
Figure 7C:
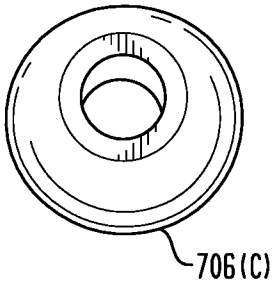
Figure 7D:
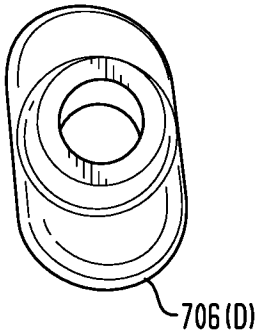

FIGS. 7A-7D are a series of diagrams illustrating physical arrangements for drive plates in accordance with embodiments presented herein. Referring first to FIG. 7A, shown is a drive plate 706(A) that has a general circular shape. FIG. 7B illustrates a drive plate 706(B) having a general tear-drop shape, while FIG. 7C illustrates a drive plate 706(C) having a generally annular shape. FIG. 7D illustrates a drive plate 706(B) having a general elliptical or oval shape.

It is to be appreciated that the drive plates shown in FIGS. 7A-7D can be used with an earhook as described elsewhere herein. However, for ease of illustration, the earhooks have been omitted from FIGS. 7A-7D.

It is also to be understood that terms such as "left," "right," "top," "bottom," "front," "rear," "side," "height," "length," "width," "upper," "lower," "interior," "exterior," "inner," "outer," "forward," "rearward," "upwards," "downwards," and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

It is to be appreciated that the embodiments presented herein are not mutually exclusive.

The invention described and claimed herein is not to be limited in scope by the specific preferred embodiments herein disclosed, since these embodiments are intended as illustrations, and not limitations, of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A coupling apparatus for a transcutaneous bone conduction device, comprising:

an external drive plate configured to be detachably mechanically connected to the transcutaneous bone conduction device and configured to transfer vibration from the transcutaneous bone conduction device to skin of a recipient; and an earhook extending directly from the external drive plate, wherein the earhook is configured to fit over a recipient's pinna to substantially support the external drive plate and the transcutaneous bone conduction device when connected to the external drive plate.

2. The coupling apparatus of 1, wherein the earhook is formed from a substantially rigid material and includes an outer covering formed from a compressible material.

3. The coupling apparatus of claim 1, wherein the earhook comprises a curved portion that is partially flexible within a plane of the earhook and is resiliently biased in a direction of the recipient's pinna to provide a clamping pressure on a superior portion of the recipient' pinna.

4. The coupling apparatus of claim 1, further comprising a supplemental support member that is configured to extend under an inferior portion of the recipient's pinna.

5. The coupling apparatus of claim 4, wherein the supplemental support member is resiliently biased so as to place a compressive force on the inferior portion of the recipient' pinna.

6. The coupling apparatus of claim 1, further comprising a spacer that is configured to space the external drive plate a distance from the recipient' pinna.

7. The coupling apparatus of claim 6, wherein the spacer is an arcuate member that extends from the external drive plate.

8. The coupling apparatus of claim 6, wherein the spacer is formed from a vibration isolation material.

9. The coupling apparatus of claim 1, wherein the earhook comprises a resiliently flexible portion connected to the external drive plate, and wherein the resiliently flexible portion is configured to enable rotational movement of the external drive plate relative to a remainder of the earhook.

10. The coupling apparatus of claim 1, further comprising an adhesive member configured to adhere a first surface of the external drive plate to skin of a recipient to fix a location of the external drive plate relative to the earhook, wherein the external drive plate comprises a second surface configured to couple to the transcutaneous bone conduction device, wherein the second surface is substantially opposite to the first surface.

11. The coupling apparatus of claim 1, further comprising an elastic adhesive carrier disposed adjacent at least a portion of the external drive plate, wherein the elastic adhesive carrier has an adhesive disposed on a skin-facing surface thereof and is configured to be stretched away from external drive plate and adhered to the skin while under tension.

12. An apparatus for coupling of a transcutaneous bone conduction device to a recipient, the apparatus comprising:

a drive plate having a first surface that is detachably mechanically connected to the transcutaneous bone conduction device, wherein the drive plate is configured to transfer vibration from the transcutaneous bone conduction device to skin of the recipient;

an adhesive member configured to adhere the drive plate to the skin of the recipient; and an earhook detachably mechanically connected to the drive plate and configured to be worn on the ear of the recipient.

13. The apparatus of claim 12, wherein the earhook comprises a curved portion that is partially flexible within a plane of the earhook and is resiliently biased in a direction of a pinna of the recipient to provide a clamping pressure on a superior portion of the pinna.

14. The apparatus of claim 12, further comprising a supplemental support member that is configured to extend under an inferior portion of a pinna of the recipient.

15. The apparatus of claim 12, further comprising a spacer that is configured to space the drive plate a distance from a pinna of the recipient.

16. The apparatus of claim 12, wherein the earhook comprises a resiliently flexible portion connected to the drive plate, and wherein the resiliently flexible portion is configured to enable rotational movement of the drive plate relative to a remainder of the earhook.

17. The apparatus of claim 12, wherein the adhesive member is an over-adhesive member configured to extend over at least a portion of an outer edge of the drive plate and to extend a distance out from the outer edge of the drive plate.

18. The apparatus of claim 12, wherein the adhesive member is a layered adhesive member formed by an adhesive carrier, a skin adhesive, and a plate adhesive.

19. The apparatus of claim 12, further comprising an elastic adhesive carrier disposed adjacent at least a portion of the drive plate, wherein the elastic adhesive carrier has an adhesive disposed on a skin-facing surface thereof and is configured to be stretched away from the drive plate and adhered to the skin while under tension.

20. A coupling apparatus for a transcutaneous bone conduction device, comprising:

an external drive plate configured to be detachably mechanically connected to the transcutaneous bone conduction device and configured to transfer vibration from the transcutaneous bone conduction device to skin of a recipient;

an earhook extending from the external drive plate, wherein the earhook is configured to fit over a recipient's pinna to substantially support the external drive plate and the transcutaneous bone conduction device when connected to the external drive plate; and an adhesive member configured to adhere a first surface of the external drive plate to skin of a recipient to fix a location of the external drive plate relative to the earhook, wherein the external drive plate comprises a second surface configured to couple to the transcutaneous bone conduction device, wherein the second surface is substantially opposite to the first surface.

21. The coupling apparatus of claim 20, wherein the earhook comprises a resiliently flexible portion connected to the external drive plate, and wherein the resiliently flexible portion is configured to enable rotational movement of the external drive plate relative to a remainder of the earhook.

22. A coupling apparatus for a transcutaneous bone conduction device, comprising:

an external drive plate configured to be detachably mechanically connected to the transcutaneous bone conduction device and configured to transfer vibration from the transcutaneous bone conduction device to skin of a recipient;

an earhook extending from the external drive plate, wherein the earhook is configured to fit over a recipient's pinna to substantially support the external drive plate and the transcutaneous bone conduction device when connected to the external drive plate; and an elastic adhesive carrier disposed adjacent at least a portion of the external drive plate, wherein the elastic adhesive carrier has an adhesive disposed on a skin-facing surface thereof and is configured to be stretched away from external drive plate and adhered to the skin while under tension.

23. The coupling apparatus of claim 22, wherein the earhook comprises a resiliently flexible portion connected to the external drive plate, and wherein the resiliently flexible portion is configured to enable rotational movement of the external drive plate relative to a remainder of the earhook.

* * * * *